United States Patent [19]

Pantalone

[11] 4,358,915

[45] Nov. 16, 1982

[54] SELF-ASSEMBLING TELESCOPABLE STRUCTURE

[75] Inventor: Antonio Pantalone, Milan, Italy

[73] Assignee: L.P.E. S.r.l., Milan, Italy

[21] Appl. No.: 193,130

[22] Filed: Oct. 1, 1980

[30] Foreign Application Priority Data

Oct. 2, 1979 [IT] Italy ..... 26197 A/79

[51] Int. Cl.[3] ..... E04H 12/18; B66C 23/34

[52] U.S. Cl. ..... 52/115; 52/118

[58] Field of Search ..... 52/111, 115, 118, 121, 52/123, 122; 182/141; 92/51, 52, 53; 91/167

[56] References Cited

U.S. PATENT DOCUMENTS

| | | | |
|---|---|---|---|
| 2,689,025 | 9/1954 | Yates | 52/115 |
| 3,252,680 | 5/1966 | Lee | 92/52 |
| 3,688,455 | 9/1972 | Zebuhr | 52/115 |

*Primary Examiner*—Price C. Faw, Jr.
*Assistant Examiner*—Eugene R. Washington
*Attorney, Agent, or Firm*—Shlesinger, Fitzsimmons & Shlesinger

[57] ABSTRACT

The invention relates to a self-assembling telescopable structure comprising a plurality of members which can be slipped and unslipped into and from each other. For the assemblage and disassembling of the structure releasable fastening members are provided for the several component parts and reversible lifting means acting between the internal component part and its next intermediary component part.

By outstretching such means it is possible to effect the unslipping of the internal component part from its next. By subsequently fastening the internal component to the external one or to an intermediate component and binding mutually the other intermediate components, it becomes possible, by contraction of said lifting means to have the mutually bound intermediate components into the unslipped internal component part. By repeating these steps, the structure is assembled, whereas, by reverting the step sequence the disassembling of the structure is obtained.

13 Claims, 6 Drawing Figures

SELF-ASSEMBLING TELESCOPABLE STRUCTURE

Figure 1:
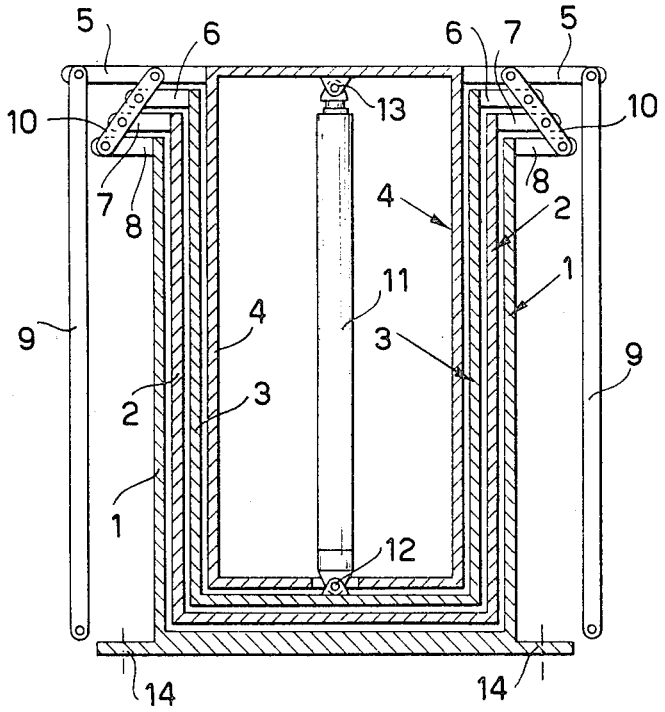
Figure 2:
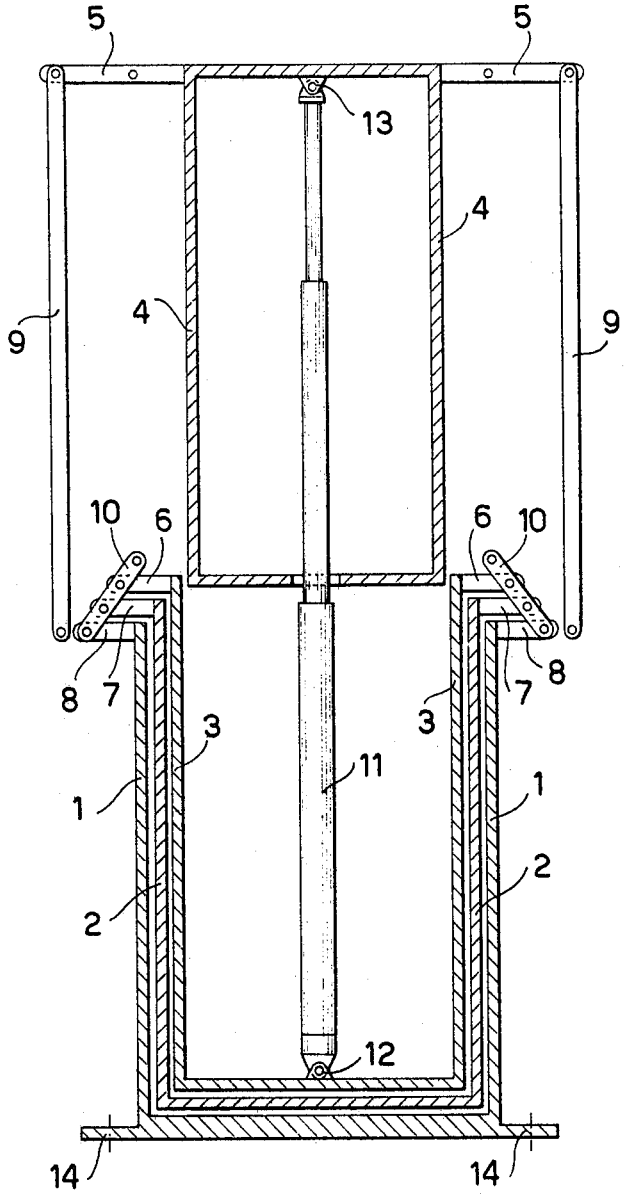

This invention relates to a self-assembling telescopable structure.

Telescopable structures are composed by a certain number of component parts which can slide the ones relative to the others, and can take a shortened configuration in which the component parts are inserted the ones into the others and the structure has a height approximately equal to that of a single component part, and an elongate configuration in which the component parts are unslipped the ones from the others so that the structure has a height approximately equal to the sum of the heights of the individual component parts.

When the structure is comprised of a considerable number of component parts, the assembling and disassembling operations, that is, the transition from the one to the other of the configurations aforementioned, become rather cumbersome and require either intricate mechanisms incorporated into the structure, such as capstans, cables, idler rollers and the like, or external contrivances or lifting means such as cranes and the like.

The self-assembling structures are conceived in such a way that they do not necessitate external lifting means for their assembly and disassembly.

An object of the present invention is to provide a self-assembling telescopable structure of the kind referred to above in which the mechanisms to be incorporated into the structure for making possible the assembly and the disassembly are simplified to a degree and permit that such operations may be performed with an extreme convenience.

This object is achieved according to the invention by a self-assembling telescopable structure comprising a plurality of component parts having substantially all the same height and which can be slipped and unslipped into and from each other and relatively to an external component part, an intermediate and an internal component part, characterized in that there are provided first releasable fastening means between the top ends of the component parts when these are slipped into each other, second releasable fastening means between the top ends of the internal component part and the top end of any of the intermediate component parts and the external component part when the internal component part is unslipped from its next intermediate component part, third releasable fastening means between the top ends of each component part, the internal one expected, and the top end of the next intermediate or internal component part, and reversible lifting means active between the top end of the internal component part and the bottom end of the next intermediate component part, adapted controllably to cause the unslipping of the internal component part from its next intermediate component part, or the slipping of the internal component part into its next intermediate component part.

Said first releasable fastening means can consist of simple connecting pins to be inserted into bores formed through appropriate extension projecting from the top ends of the slidable component parts: in practice, as will be better explained hereinafter, it suffices to be able to connect together the top ends of two or of all the intermediate component parts of the telescopable structure.

The second releasable fastening means can consist of rods pivoted in correspondence with the top end of the internal component part and which can be connected by means of connection pins with the top ends of the external component part or of the intermediate component parts.

Said rods have a length which is nearly equal to the height of the internal component part of the telescopable structure. Their pivotal point relative to the top end of the internal component part can be, with advantage, made radially displaceable relative to the axis of the component part concerned.

Lastly, said third releasable fastening means can consist of attachments, such as angles and the like and they are intended to hold any component part rigidly blocked relative to its next in the outstretched condition of the structure.

The lifting means which are active between the internal component part and its next intermediate component part in order to cause, alternately, the mutual unslipping or slipping movements can consist, with advantage, of a jack, for example a double-acting hydraulic jack fitted with the appropriate controls, but equivalent mechanical means can be provided, such as a screw mechanism.

The extension stroke of such hydraulic jack or its equivalent mechanical means is nearly equal to its minimum length and such a length is nearly equal to the height of each individual component part of the telescopable structure.

If the component parts of the structure have the form of a solid bottom basket, it is obvious that the bottom wall of internal component part must have an appropriate passageway for the hydraulic jack or for its equivalent mechanisms.

The slidable component parts of the structure which have all substantially the same height can have any cross-sectional shape, for example square, rectangular or circular.

The lifting means act in appropriate axial relationship with the component parts and the fastening means are symmetrically arranged to prevent jamming during progress of the relative motions of the component parts.

The invention will be more detailedly described hereinafter with reference to the accompanying drawings which are illustrative of an exemplary and non-limiting embodiment of a telescopable self-assembling structure constructed in accordance with the present invention.

In the drawings:

FIG. 1 is a vertical cross-sectional view of the structure in its fully contracted configuration and FIGS. from 2 to 6 inclusive show the same structure in its various subsequent assembling stages.

The telescopable structure shown herein is composed by four component parts which can mutually be slipped into and unslipped from each other, it being understood, however, that the number of the component parts can be any number consistent with the requirements of stability. It will be assumed that the component parts of the structure have a rectangular cross-sectional outline, although this is by no way compulsory.

The component parts of the structure can slide, by virtue of appropriate guiding means not shown herein, the ones relative to the others.

More particularly, in the example shown herein, there are an outermost component part 1, two intermediate component parts 2 and 3 and an innermost component part 4.

All the component parts may have the shape of baskets with a bottom wall and the innermost component part 4 is closed also at its top, whereas its bottom wall has a passageway for the purposes which will be set forth in more detail hereinafter.

In the shortened condition of the structure (appropriate for shipping) the innermost component part 1 holds nearly completely the intermediate component parts 2 and 3 as well as the innermost component part 4 (see FIG. 1).

The structure comprises three sets of releasable fastening members for the component parts.

A first set of such fastening members is intended mutually to connect the top ends of two or more component parts which are slipped into one another. To this purpose, pins are provided which can be inserted into bores of bored ears 5, 6, 7, 8 protruding from the top ends of the component parts 1, 2, 3, 4, and in the bores of bored plates 10. Preferably, a plurality of such ears and relevant plates is provided and these members are symmetrically arranged along the periphery of the component parts, at least a couple of confronting members being provided.

A second set of fastening members is intended to connect the top end of the innermost component part 4 to the top end of one of the intermediate component parts 2, 3 or of the outermost component part 1. These fastening members consist of rods 9 which are pivoted in correspondence with the top end of the innermost component part 4, for example to the projecting ears 5 thereof. These rods 9 have a length which is nearly equal to the height of the innermost component part 4 and have, at their free end, a bore in which a pin can be inserted to provide a connection with either of the bored projecting ears 6, 7 and 8. It is preferred that also these rods 9 be provided pairwise. Their pivotal point relative to the ears 5 can be properly shifted in the radial direction relative to the axis of the component part 4.

As third releasable fastening means there are then provided angles 15, 16, 17 which can be secured by bolts to the top ends of the component parts 1, 2, 3 and to the bottom ends of the component parts 2, 3, 4 rigidly to block the component parts relative to each other in the outstretched condition of the structure.

Between the top wall of the innermost component part 4 and the bottom wall of the intermediate component part 3 immediately adjoining it, a double-acting hydraulic jacks 11 is active: the jack is passed at its bottom, through the passageway provided through the bottom wall of the innermost component part 4 and is secured to the bottom wall of the intermediate component part 3 by a hinged connection 12, whereas its top end is secured to the top wall of the innermost component part 4 by a hinged connection 13. The minimum length of the jack 11 is nearly equal to the height of each individual component part, whereas the extension stroke is roughly equal to said minimum length, so that, in the outstretched condition, the jack has a length which is nearly twice the minimum length. The jack 11 acts axially relative to the component parts of the telescopable structure. The operation of the structure and the assembly and disassembly stages are now described in connection with FIGS. 1 to 6 inclusive.

In the shortened or shipping configuration all the component parts from 1 to 4 are properly mutually connected by the plates 10 and pins inserted in their bores and in the bores of the ears from 5 to 8. At the location in which the structure is to be erected, it is anchored by means of flanges 14 of the outermost component part 1. Now, the innermost component part 4 is cleared by removing the connection pins between the ears 5 and the plates 10.

Then, the hydraulic jack 11 is actuated in the sense of outstretching. To this purpose, for example, a hydraulic controlling unit can be used, arranged in the innermost component part 4, the unit being not shown herein, and electrically fed by an electric cable. The outstretching of the jack causes the nearly total unslipping of the innermost component part 4 from its next intermediate component part 3 (see FIG. 2).

Figure 3:
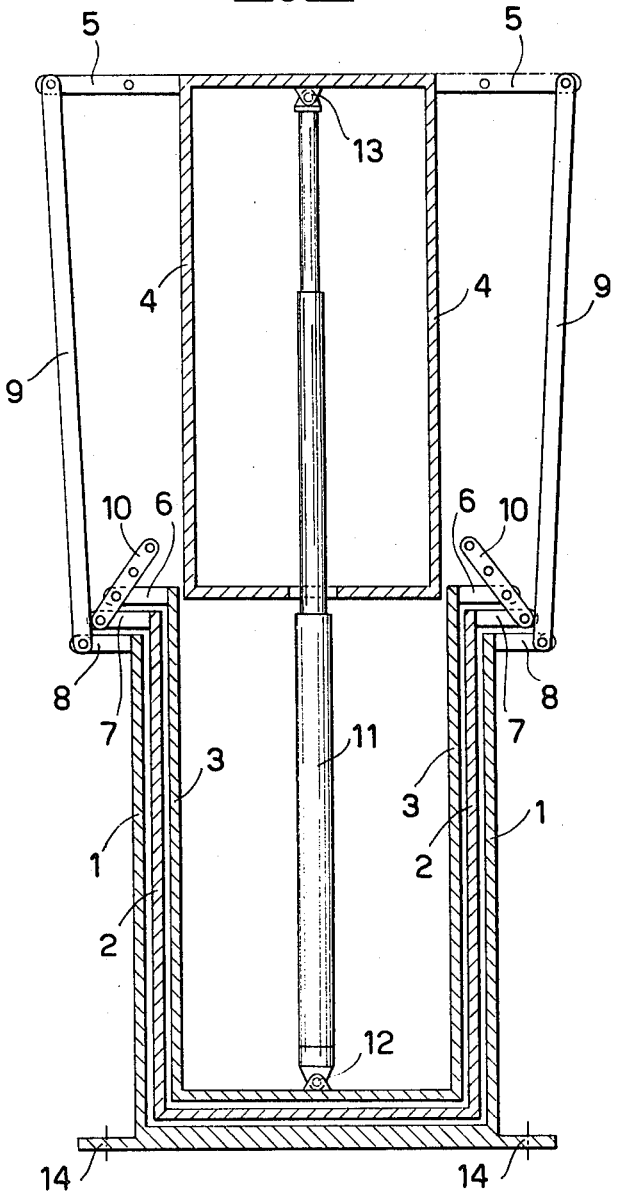

At this stage the plates 10 are released from the ears 8 of the outermost component part 1 and now the ends of the rods 9 are fastened to said ears 8 (see FIG. 3). The top ends of the intermediate component parts 2 and 3 are thus secured to each other by the plates 10.

Figure 4:
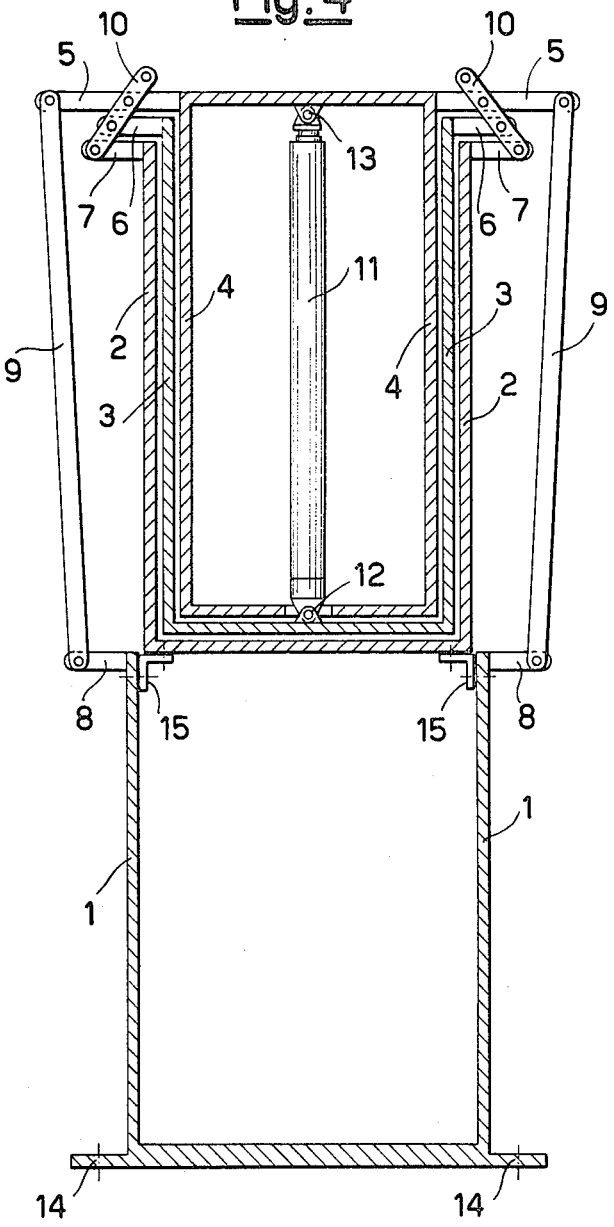
Figure 5:
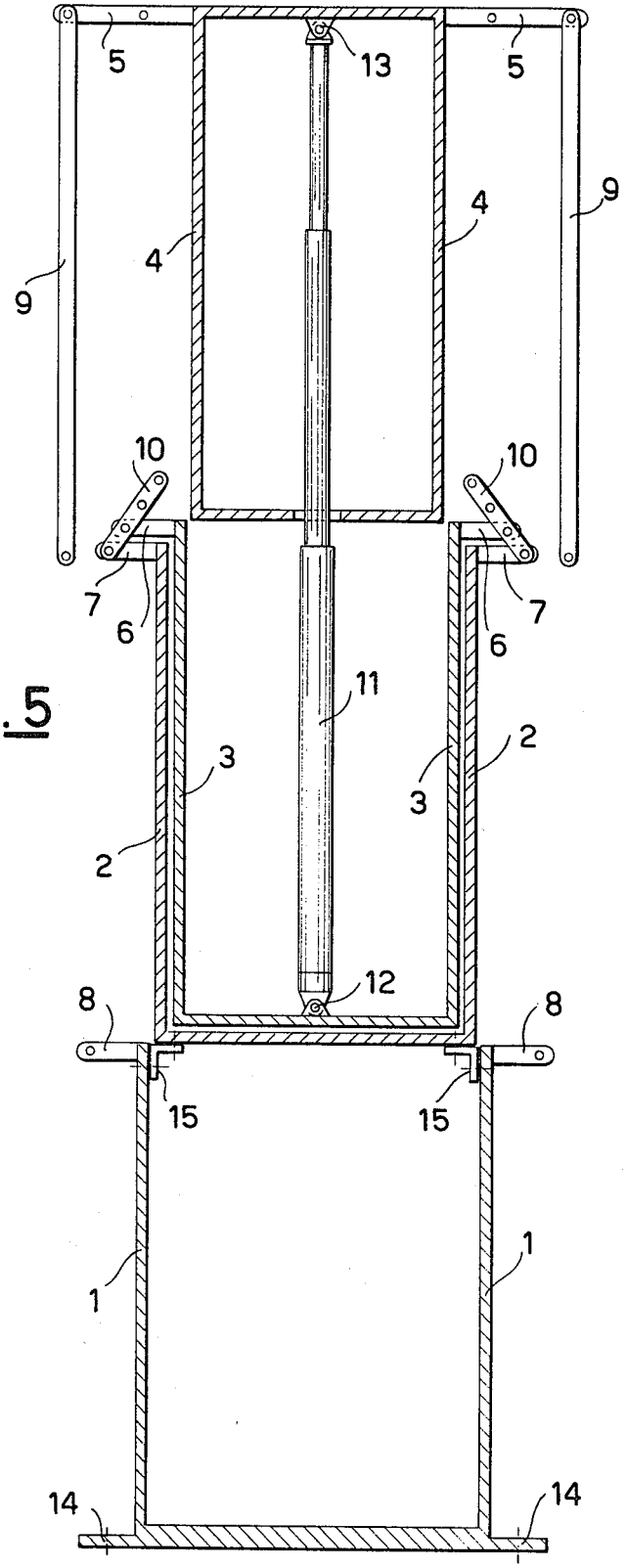
Figure 6:
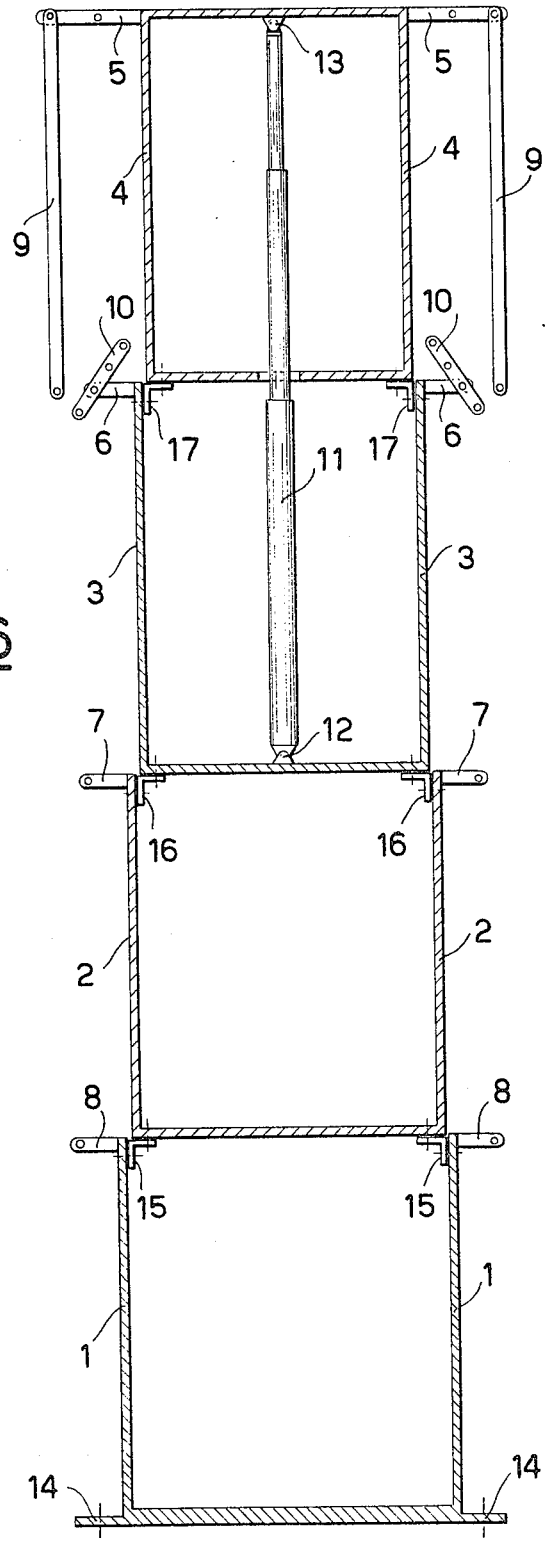

By actuating now the hydraulic jack 11 in the sense of the contraction it is obvious that the intermediate component parts 2 and 3 are lifted, slipped into the innermost component part 4 and unslipped from the outermost component part 1 (see FIG. 4). The outer most component part 1 and the first intermediate component part 2 can now be mutually rigidly connected by the angles 15.

Subsequently, the rods 9 are released from the ears 8 of the outermost component part 1, whereas the intermediate component parts 2 and 3 remain mutually connected by the plates 10. By actuating the hydraulic jack 11 again in the sense of outstretching, the innermost component part 4 is again lifted and unslipped from the intermediate component part 3 until taking the position shown in FIG. 5. Once that this stage has been reached, the plates 10 are released from the ears 7 of the component part 3 and said plates are now connected to the ends of the rods 9. By the subsequent contraction of the jack 11, the component part 3 is slipped into the innermost component part 4 and slipped from the component part 2 to be then rigidly connected to the latter by the angles 16. By releasing the rods 9 from the ears 7 and actuating the jack 11 again in the sense of outstretching, the innermost component part 4 is lastly brought to the position shown in FIG. 6, in which it can rigidly be connected to the component part 3 by the angles 17. It is apparent that the operative stages outlined above for the case of a 4-component structure can be repeated as such for structures having any number of slidable component parts. Substantially, an alternate sequence of unslipping operations is in the question, for the innermost component part and of lifting operations of the intermediate component parts, on taking into account that in each subsequent operation of lifting there is one intermediate component part less to be lifted.

On completion of the assembly of the structure the jack 11 can be cleared of the hinged connection 12, can be shrunk and left inoperative and properly covered, or it can be removed together with the controlling unit and properly stored. Also the rods 9 and the plates 10 can be overhauled and stored.

The operation for disassembling the structure can be performed by applying a reversed order of the operative stages outlined above. Also during this operation stages of outstretching and stages of shrinking of the hydraulic jack can be alternated while providing before each stage to fasten or to clear mutually the component parts of the structure.

As indicated above, the hydraulic jack can be replaced by any other equivalent mechanisms, such as a screw mechanism.

It is important to observe, at any rate, that such a mechanism can have reduced stroke and size.

Also the several releasable fastening members provided for mutually connecting the component parts of the structure can be embodied differently from what has been described and diagrammatically shown herein, provided that they permit to fasten or to release rapidly and reliably the component parts with respect to each other as required in the several operative stages of assembly and disassembly of the structure.

Obviously the structure will be completed by appropriate auxiliary instruments such as a working platform integral with the innermost component part (this, in the outstretched condition becomes the top member of the structure), ladders and others, to enable an attendant to manipulate during the assembly and disassembly stages the releasable fastening members in the manner dictated by the operative stages.

From the foregoing description it is apparent that the telescopable structure according to the invention is extremely simple to build and is deprived of intricate mechanisms and systems incorporated in the structure itself for assembly and disassembly, contrary to the conventional self-assembling structures in which retained such mechanisms incorporated in the structure and thus subjected to weathering agents and to a rapid consequent wear.

I claim:

1. A self-assembling telescopable structure comprising a plurality of component parts each having a height substantially equal for all of them, and which can be slipped and unslipped into and from an external component part, intermediate component parts and innermost component part, characterized in that there are provided first releasable fastening means between the top ends of the component parts when they are slipped into one another, second releasable fastening means between the top end of the innermost component part and the top end of any of the intermediate and the outermost component part when the innermost component part is slipped from its next intermediate component part, third releasable fastening means between the top end of each component part, the innermost one excepted, and the bottom end of the next intermediate or innermost component part, and reversible lifting means acting between the top end of the innermost component part and the bottom end of the next intermediate component part adapted controllably to cause the unslipping of the innermost component part from the next intermediate component part and the slipping of the innermost component part into its next intermediate component part, said third fastening means comprising angle members and means for releasably affixing same to the associated components.

2. Structure according to claim 1, characterized in that said first releasable fastening members are connecting pins to be inserted into bores of extensions protruding externally in correspondence with the top ends of the component parts.

3. Structure according to claim 2, characterized in that said first fastening members further comprise bored connection plates.

4. Structure according to claim 1, characterized in that said second releasable fastening members consist of rods pivoted in correspondence with the top end of the innermost component part and connectable by means of connecting pins to the top ends of the outermost component part or of the intermediate component parts.

5. Structure according to claim 4, characterized in that said rods have a length nearly equal to the height of the innermost component part.

6. Structure according to claim 4, characterized in that the point of pivoting of the rods to the top end of the innermost component part can be radially displaced relative to the axis of the component part.

7. Structure according to claim 1, characterized in that the lifting means consist of a double acting jack with its respective control members.

8. Structure according to claim 1, characterized in that the jack has an extension stroke nearly equal to its minimum length, the latter, in turn, being nearly equal to the height of a component part of the structure.

9. Structure according to claim 1, characterized in that the lifting means are composed by a screw and nut mechanism.

10. Structure according to claim 1, characterized in that the component parts have a solid bottom wall, the bottom wall of the innermost component part having a passageway for said lifting means.

11. Structure according to claim 1, characterized in that the lifting means act axially relative to the component parts of the structure.

12. Structure according to claim 1, characterized in that the lifting means are releasably fastened to the innermost component part and to the next intermediate component part.

13. Structure according to claim 1, characterized in that the fastening members are arranged symmetrically with respect to the component parts of the structure.

* * * * *